United States Patent [19]

Bosco et al.

[11] Patent Number: 4,583,383

[45] Date of Patent: Apr. 22, 1986

[54] KEY-TURNING DEVICE

[76] Inventors: Joseph Bosco; Deborah Bosco, both of 850 Country Club Dr., Burbank, Calif. 91501

[21] Appl. No.: 695,199

[22] Filed: Jan. 28, 1985

[51] Int. Cl.[4] ..... E05B 19/04

[52] U.S. Cl. ..... 70/408; 70/458

[58] Field of Search ..... 70/408, 456 R, 458; 81/3.55, 3.47, 3.07, 3.27; 292/DIG. 63, 347

[56] References Cited

U.S. PATENT DOCUMENTS

| | | | |
|---|---|---|---|
| 3,572,186 | 3/1971 | Dillerd | 81/3.27 |
| 3,587,260 | 6/1971 | Tajini | 70/408 |
| 3,786,659 | 1/1974 | Elder | 70/408 |
| 4,102,166 | 7/1978 | Hughes | 70/408 |
| 4,504,087 | 3/1985 | Pennington | 292/347 |

FOREIGN PATENT DOCUMENTS

| | | | |
|---|---|---|---|
| 1177054 | 10/1984 | Canada | 81/3.07 |

*Primary Examiner*—Robert L. Wolfe

[57] ABSTRACT

The device comprises a generally L-shaped body of plastic, metal or the like, with two flat arms of unequal length set at an angle from each other about 105°–120°. The shorter arm has a key-receiving slot at its free end, while the longer arm has a beverage can pull tab-receiving slot at its free end for prying up that tab. The body may also include a hook to pull the pried up tab completely from the can. The device also includes a key chain-receiving opening. The key-receiving slot can have sloped upwardly converging walls to accommodate keys of various sizes. Such walls may be integral to the body or part of an insert disposed in the key-receiving slot. The device enables car keys and the like to be easily temporarily fitted therein and extends therefrom for insertion in a lock. The key can then be easily turned in the lock by rotating the longer arm away from the lock, thus avoiding bumping and chipping the users fingernails against the lock. The device is simple, durable, inexpensive, efficient and portable and preserves dressed fingernails.

9 Claims, 3 Drawing Figures

KEY-TURNING DEVICE

BACKGROUND OF THE INVENTION

1. Field of the Invention

The present invention generally relates to key devices and, more particularly, to a novel key-turning device which prevents fingernail chipping.

2. Prior Art

Considerable effort and expense are involved when womens' and mens' fingernails are shaped, painted, coated, polished and otherwise treated. Frequently, those finished beautified nails are thereafter inadvertantly chipped and cracked when a vehicle key is inserted into the steering column or dashboard and the key is turned to start the vehicle engine. Thus, the key is relatively short, and when it is inserted in the steering column or dashboard lock, only the base of the key lies outside the lock and very near the steering column. Considerable effort must be exerted to grip the key base and turn it by the fingers against the lock spring. Frequently, the key base is so short that the fingertips overlap the base and collide with the lock on the steering column or adjacent parts of the steering column or dashboard causing the nail tips to crack, chip and break off, ruining the appearance of the nails. This is particularly likely to happen when the fingernails are long, natural built-up or artificial nails. Moreover, women with weak fingers frequently find it difficult to overcome the lock's spring tension and physically turn the key far enough to cause engine ignition.

Accordingly, there is a need for a device which will give better leverage for turning a vehicle ignition key and which will protect the user's nails against damage against the steering column and/or ignition lock, etc. It would also be desireable if the device had the ancillary function of facilitating prying up the opening ring or other tab from a beverage can, an operation which is generally difficult to do and also frequently results in chipping and cracking of fingernails. It would further be desireable if the device could easily strip the pried up opening tab from the beverage can.

SUMMARY OF THE INVENTION

The improved key turning device of the present invention satisfies all the foregoing needs. The device is substantially as set forth in the Abstract above. Thus, the device comprises a generally L-shaped flat body, with slots on the opposite open ends of its arms. The arms are preferably of uneven length and the slot in the shorter arm is dimensioned to releasably receive the base of a key, with the shank thereof protruding therefrom for insertion into a vehicle steering column or dashboard ignition lock or other lock. The longer arm of the body diverges therefrom at an obtuse angle of preferably about 105°–120° or the like so that when that longer arm is gripped and rotated, the user's fingers are spaced well apart from the ignition lock and steering column or dashboard in which the lock is disposed, thus preventing hand nail impingement thereon, and chipping and breakage of the nails.

The slot in the longer arm is useable to slip up and receive a ring-shaped opener tab or the like of a beverage can for easy prying up, all without hand nail contact and damage from the can. The device body can also include a hook to hold the pried up ring tab and easily strip it from the can. The device body can have a ring or opening for securing a key chain to or through it for ease of carrying the device with a set of keys. Various other features of the invention are set forth in the following detailed description and accompanying drawings.

DRAWINGS

DETAILED DESCRIPTION

Figure 1:
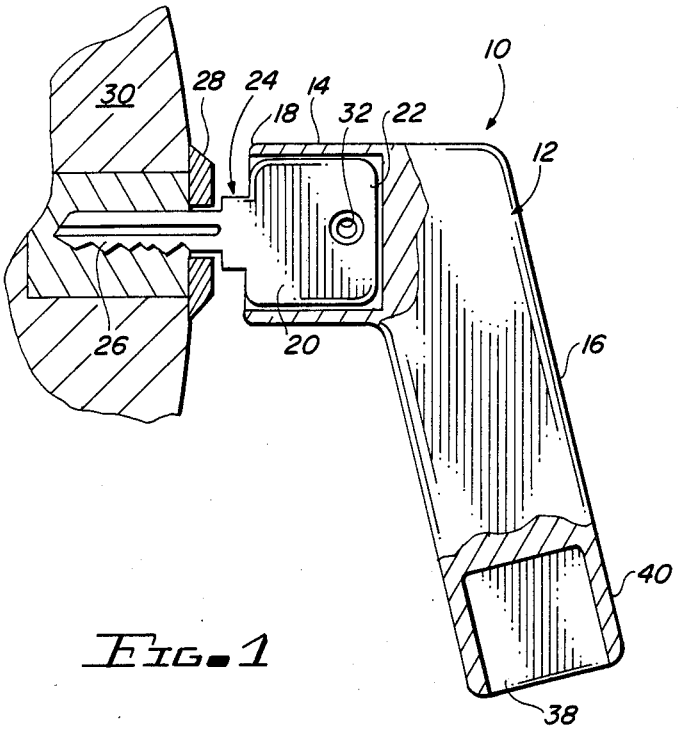
FIG. 1 is a schematic side elevation, partly broken away, and partly in section of a first preferred embodiment of the improved key turning device of the present invention, shown with a key therein inserted and also inserted into an ignition lock in a vehicle steering column.
Figure 2:
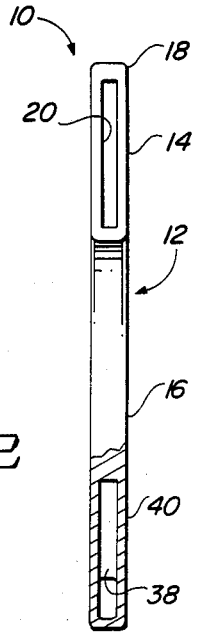
FIG. 2 is a schematic front elevation, partly broken away, of the device of FIG. 1; and, FIG. 3 is a schematic side elevation, partly broken away, of a second preferred embodiment of the improved key turning device of the present invention.

FIGS. 1 and 2.

Now referring to FIGS. 1 and 2 of the drawings, a first preferred embodiment of the improved key turning device of the present invention is schematically depicted therein. Thus, device 10 is shown which comprises a generally L-shaped flat body 12 of metal, plastic, wood, fiberglass, etc., having a short arm 14 and a long arm 16 integrally connected thereto and extending therefrom at an obtuse angle of, for example, about 105°–120°. Arm 14 has at its free end 18 a slot 20 dimensioned to releasably receive the base 22 of a key 24 so that the key shank 26 extends outwardly therefrom for insertion into an ignition lock 28 or other lock (door, safe, etc.). When so inserted, as shown in FIG. 1, long arm 16 extends well away from lock 28, so that when body 12 is rotated by arm 16, such rotation against the spring (not shown) in lock 28 is easy, due to the added leverage (mechanical advantage) easily provided by arm 16. Arm 16 is also relatively large and easy to grip so that the user's fingers and particularly fingernails are kept well away from lock 28 and vehicle steering column or dishboard 30 in which lock 28 is secured. Thus, the user's fingernails are preserved by device 10 against all forms of damage by contact with lock 28 or column 30. Such damage can be in the form of chipping, cracking and breakage. This preservation occurs even when the nails are very long and have been carefully shaped, painted, polished and otherwise manicured. Thus, device 10 is particularly useful for women drivers with expensively well manicured nails and those with weak hand strength. Device 10 can be used to equal advantage on other locks.

Device 10 include means for connecting it to a key chain or the like. This may comprise a transverse opening 32 through end 18, or a loop (not shown) or the like.

A slot 38 similar to slot 20 appears in the free end 40 of arm 16 and is dimensioned to receive the tab (not shown), such as the ring tab, of a beverage can or the like to enable the user to pry up such lid without using and endangering the fingernails. The tab can then be pulled to open the can.

Device 10 is simple, light weight, small, inexpensive, durable and effective to preserve the fingernails and facilitate tab prying and key turning.

FIG. 3.

Figure 3:
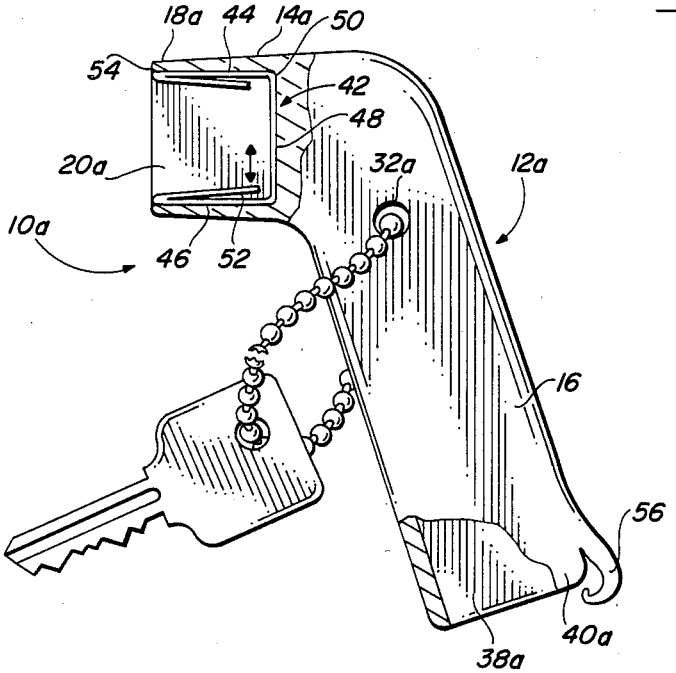

A second preferred embodiment of the improved device of the present invention is schematically shown in FIG. 3. Thus, device 10*a* is shown. Components thereof similar to those of device 10 bear the same numerals, but are succeeded by the letter "a". Device 10*a* is the same as device 10, including body 12*a*, arms 14*a* and 16*a*, and ends 18*a* and 40*a*, with slots 20*a* and 38*a*, except that arms 14*a* and 16*a* diverge more than arms 14 and 16, opening 30*a* is in arm 16*a* instead of arm 14*a*, and slot 20*a* is lined with U-shaped insert 42 of metal, plastic, etc., having an upper horizontal outer wall 44, lower horizontal outer wall 46, interconnecting rear wall 48 and converging flexible inner top and bottom walls 50 and 52 secured to the front 54 thereof. Wall 50 and 52 releasably grip the bases of keys of various sizes to hold them in slot 20*a*. It will be understood that, if desired, insert 42 be made integral with body 12*a* and that walls 50 and 52 can be non-flexible and, if desired, could be secured along their length directly to body 12*a*.

In addition, body 12*a* has a hook 56 secured to the exterior thereof with which to pull a ring tab on a beverage can to open the can after prying up the can with end 40*a*. Accordingly, device 10*a* has the uses and advantages of device 10.

Further modifications, changes, alterations and additions can be made in the improved device of the present invention, its components and parameters. All such changes, modifications, alterations and additions as are within the scope of the appended claims form part of the present invention.

What is claimed is:

1. An improved nail-protecting key turning device, said device comprising, in combination:

(a) an elongated body having a key-receiving recess at one end thereof, with two arms of unequal length, the longer arm diverging from said shorter arm at an obtuse angle and bearing said key-receiving end, whereby a key protruding from said key-receiving end can easily be turned in a lock by rotating said longer arm without danger of striking fingernails against the lock during said key turning; and, (b) means for connecting said body to a key chain.

2. The improved key turning device of claim 1 wherein said connector means comprises an opening in said body through which a key chain can be threaded.

3. The improved key turning device of claim 1 wherein said body is generally flat and elongated, wherein said openings are slots and wherein the walls defining the top and bottom of said key-receiving opening converge inwardly to accommodate the bases of keys of different sizes.

4. The improved key turning device of claim 3 wherein said converging walls are resilient so as to releasably grip a key when disposed therebetween.

5. The improved key turning device of claim 4 wherein said converging walls comprise a resilient insert releasably disposed in said key-receiving opening.

6. The improved key turning device of claim 5 wherein said insert comprises a generally U-shaped strip formed of an upper outer wall, lower outer wall and interconnecting rear wall and wherein said strip has a pair of converging key-gripping inner walls connected to the front ends of said upper outer and lower outer walls.

7. These improved key turning device of claim 1 wherein a beverage pull-tab receiving opening is disposed in the opposite end of said body.

8. The improved key turning device of claim 1 wherein said body includes a beverage pull tab hook extending from the outer surface thereof for removing a pull tab from a beverage can after lifting the pull tab by levering it up when it is disposed in said pull tab-receiving opening.

9. The improved key turning device of claim 1 wherein said body is plastic and wherein said main portion is angled away from the remainder of said body at an angle of about 115°–120°.

* * * * *